US008400126B2

(12) United States Patent
Iacob et al.

(10) Patent No.: US 8,400,126 B2
(45) Date of Patent: Mar. 19, 2013

(54) FLOATING-GATE PROGRAMMABLE LOW-DROPOUT REGULATOR AND METHOD THEREFOR

(75) Inventors: Radu H. Iacob, Santa Clara, CA (US); Sabin A. Eftimie, Bucharest (RO); Cornel D. Stanescu, Bucharest (RO); Andreea Creosteanu, Bucharest (RO); Marian Badila, San Jose, CA (US)

(73) Assignee: Semiconductor Components Industries, LLC, Phoenix, AZ (US)

( * ) Notice: Subject to any disclaimer, the term of this patent is extended or adjusted under 35 U.S.C. 154(b) by 394 days.

(21) Appl. No.: 12/760,150

(22) Filed: Apr. 14, 2010

(65) Prior Publication Data

US 2011/0254521 A1 Oct. 20, 2011

(51) Int. Cl.
*G05F 1/44* (2006.01)

(52) U.S. Cl. ..... 323/282

(58) Field of Classification Search ..... 323/267, 323/270–275, 281–285, 351
See application file for complete search history.

(56) References Cited

U.S. PATENT DOCUMENTS

| | | | | |
|---|---|---|---|---|
| 5,334,928 | A * | 8/1994 | Dobkin et al. | 323/280 |
| 6,703,885 | B1 | 3/2004 | Fan et al. | |
| 7,218,168 | B1 | 5/2007 | Rahman | |
| 7,265,608 | B1 | 9/2007 | Lu et al. | |
| 7,477,046 | B2 * | 1/2009 | Eberlein | 323/273 |
| 7,482,844 | B2 * | 1/2009 | Brady et al. | 327/74 |
| 7,531,996 | B2 * | 5/2009 | Yang et al. | 323/282 |
| 7,545,126 | B2 * | 6/2009 | Su et al. | 323/273 |
| 7,834,600 | B2 * | 11/2010 | Bassett et al. | 323/265 |
| 7,964,992 | B2 * | 6/2011 | Apfel | 307/82 |
| 8,169,202 | B2 * | 5/2012 | Chen | 323/273 |
| 2006/0120163 | A1 * | 6/2006 | Serrano et al. | 365/185.24 |
| 2006/0261797 | A1 * | 11/2006 | Man et al. | 323/314 |
| 2007/0046271 | A1 | 3/2007 | Zolfaghari | |
| 2011/0187344 | A1 * | 8/2011 | Iacob et al. | 323/315 |
| 2011/0248688 | A1 * | 10/2011 | Iacob et al. | 323/234 |

OTHER PUBLICATIONS

Stanescu, Cornel; Caracas, Cristi; Aungurencei, Gabriel; and Russell, Anthony, "Quick-Start CMOS Voltage Reference for Positive LDOS," CAS 2005 Proceedings, 2005 International Semiconductor Conference, Oct. 5, 2005, v. 2, pp. 379-382.

Stanescu, C.; Iacob, R.; Dinca, C.; Caracas, C.; Profirescu, O.; "0.5A fast CMOS LDO," International Semiconductor Conference, 2009. CAS 2009, vol. 2, pp. 473-476.

Micrel, Inc., Datasheets for MIC2826, Jul. 2009, Micrel, Inc.; pp.1-27.

Actions on the Merits for Copending U.S. Appl. No. 12/759,541, filed Apr. 13, 2010.

* cited by examiner

*Primary Examiner* — Adolf Berhane
(74) *Attorney, Agent, or Firm* — Paul J. Polansky

(57) ABSTRACT

In an embodiment, a low-dropout (LDO) regulator includes at least one of a programmable voltage reference and a programmable frequency compensation circuit and is configurable to produce an output voltage. The programmable voltage reference includes a floating-gate transistor coupled to a reference output and configurable for providing a reference voltage to an input of an error amplifier. The programmable frequency compensation circuit is responsive to a programmable current reference circuit that includes at least one floating-gate transistor that is configurable to adjust a frequency compensation parameter. A control circuit is provided to selectively program floating gates of the floating gate transistors to adjust the output voltage and/or to adjust a frequency component of the output voltage.

19 Claims, 7 Drawing Sheets

FLOATING-GATE PROGRAMMABLE LOW-DROPOUT REGULATOR AND METHOD THEREFOR

CROSS-REFERENCE TO RELATED APPLICATION

Related subject matter is found in co-pending U.S. patent application Ser. No. 12/759,541 filed on Apr. 13, 2010, entitled "Programmable Low-Dropout Regulator and Methods Therefor," by Radu H. Iacob et al. and assigned to the assignee hereof.

FIELD

The present disclosure is generally related to programmable low-dropout regulators and methods therefor.

BACKGROUND

Low drop out (LDO) regulators are circuits that are configurable to operate with a very small input-output differential voltage, while providing a nominal regulated output voltage. Conventionally, parameters associated with such LDO regulators are adjustable based on one-time programmable methods, such as laser trimming or electrical metal wire fuse melting during production testing. Such devices are sometimes referred to as one-time-programmable (OTP) devices.

Currently, the selection of a parameter value out of a range of fixed values is implemented by metal mask options. Some LDO products offer customers the ability to select a slightly modified value relative to the nominal output voltage DC level by connecting an external control pin to ground or to a certain input voltage level. However, such devices offer limited trimming options, which may be inadequate to adjust performance of such LDO regulators under application-specific operating conditions.

High precision LDO voltage regulators require fine tuning of the DC and AC parameters, which fine tuning is typically performed during the wafer level front-end testing of the manufacturing flow. However, the assembly process produces mechanical stresses, which may induce offsets that affect the post-assembly precision of the packaged part. Conventional trimming options may be inadequate to compensate for such post assembly offsets.

BRIEF DESCRIPTION OF THE DRAWINGS

In the following description, the use of the same reference numerals in different drawings indicates similar or identical items.

DETAILED DESCRIPTION OF ILLUSTRATIVE EMBODIMENTS

Embodiments of a programmable LDO regulator are disclosed below that provide a means for high-precision analog trimming of the DC and AC parameters of the output voltage. In particular, the programmable LDO regulator includes a non-volatile programmability that can be executed both at a wafer level during front-end testing, as well as after chip assembly, including during back-end testing and/or during user-mode operation.

Different LDO regulators often feature a wide range of DC and AC parameters, which are implemented by metal options for the same integrated circuit. While such metal masks can be eliminated using digital programmability to adjust various DC and AC parameters, digital programmability has an intrinsic precision limitation due to its discrete variation. Thus, embodiments of an LDO regulator disclosed below include floating-gate metal oxide semiconductor (MOS) devices, featuring non-discrete (analog) trimming capabilities to provide a high level of precision. Such floating-gate MOS devices are programmable using a control circuit. Further, a serial interface is disclosed for communicating data and control signals to the control circuit for configuring the LDO regulator.

Figure 1:
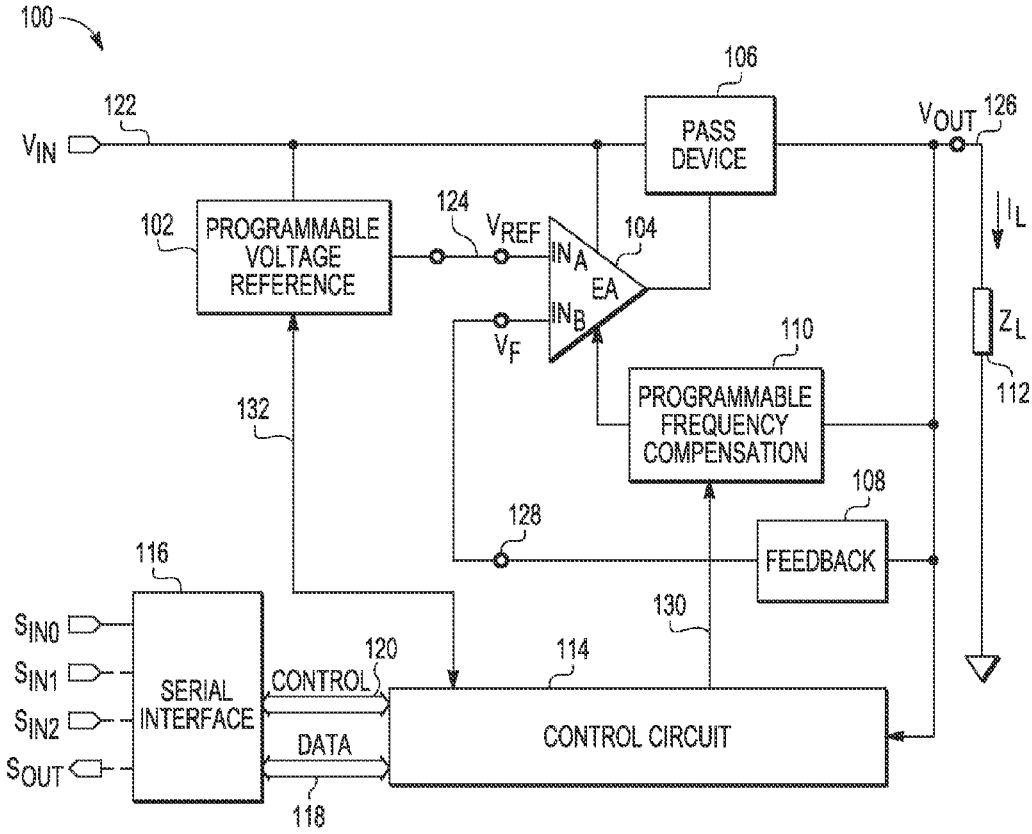
FIG. 1 is a partial schematic and partial block diagram of an embodiment of a programmable LDO regulator.

FIG. 1 is a partial schematic and partial block diagram of an embodiment of a programmable LDO regulator 100. LDO regulator 100 includes a programmable voltage reference 102 including a first terminal connected to a voltage input terminal 122 for carrying an input voltage ($V_{IN}$), a control input 132 connected to control circuit 114, and a reference output 124 for providing a reference voltage ($V_{REF}$) to a first input of an error amplifier 104. Error amplifier 104 includes a second input connected to a feedback terminal 128 for receiving a feedback signal from feedback circuit 108. Additionally, error amplifier 104 includes an output connected to pass device 106, a power input connected to voltage input terminal 122, and a control input connected to a programmable frequency compensation circuit 110.

Pass device 106 includes a first input connected to the voltage input terminal 122 and an output terminal 126 to provide an output voltage and a load current ($I_L$) to a load, which is represented by a load impedance ($Z_L$) 112. Feedback circuit 108 includes an input connected to output terminal 126 and feedback terminal 128 connected to the second input of error amplifier 104.

Programmable frequency compensation circuit 110 includes a compensation input connected to output terminal 126 and a compensation output connected to the control input of error amplifier 104. Programmable frequency compensation circuit 110 also includes a compensation control input 130 connected to control circuit 114.

Control circuit 114 is connected to a serial interface 116 to receive data 118 and control signals 120. Serial interface 116 can be a custom one-wire, two-wire or three-wire serial interface. Alternatively, serial interface 116 can be a standard integrated circuit (IC)-to-IC ($I^2C$) bus interface, a serial peripheral interface (SPI), a micro-wire serial interface, a universal serial bus interface, or another serial interface. Serial interface 116 is configurable to connect to an external source to receive data and control information, which can be used by control circuit 114 to configure at least one of programmable voltage reference 102 and programmable frequency compensation circuit 110. The external source may be a Power Management Integrated Circuit (PMIC), a system on a chip (SOC) circuit, another type of circuit, or any combination thereof.

As shown in FIG. 1, programmable LDO regulator 100 includes a programmable voltage reference using floating-gate transistors to provide a variable reference voltage. In one embodiment, the variable voltage reference provides a reference voltage to the error amplifier to make the output voltage programmable. In another embodiment, the variable reference voltage is used to adjust frequency parameters. In yet another embodiment, both uses of the variable reference voltage are combined.

Figure 2:
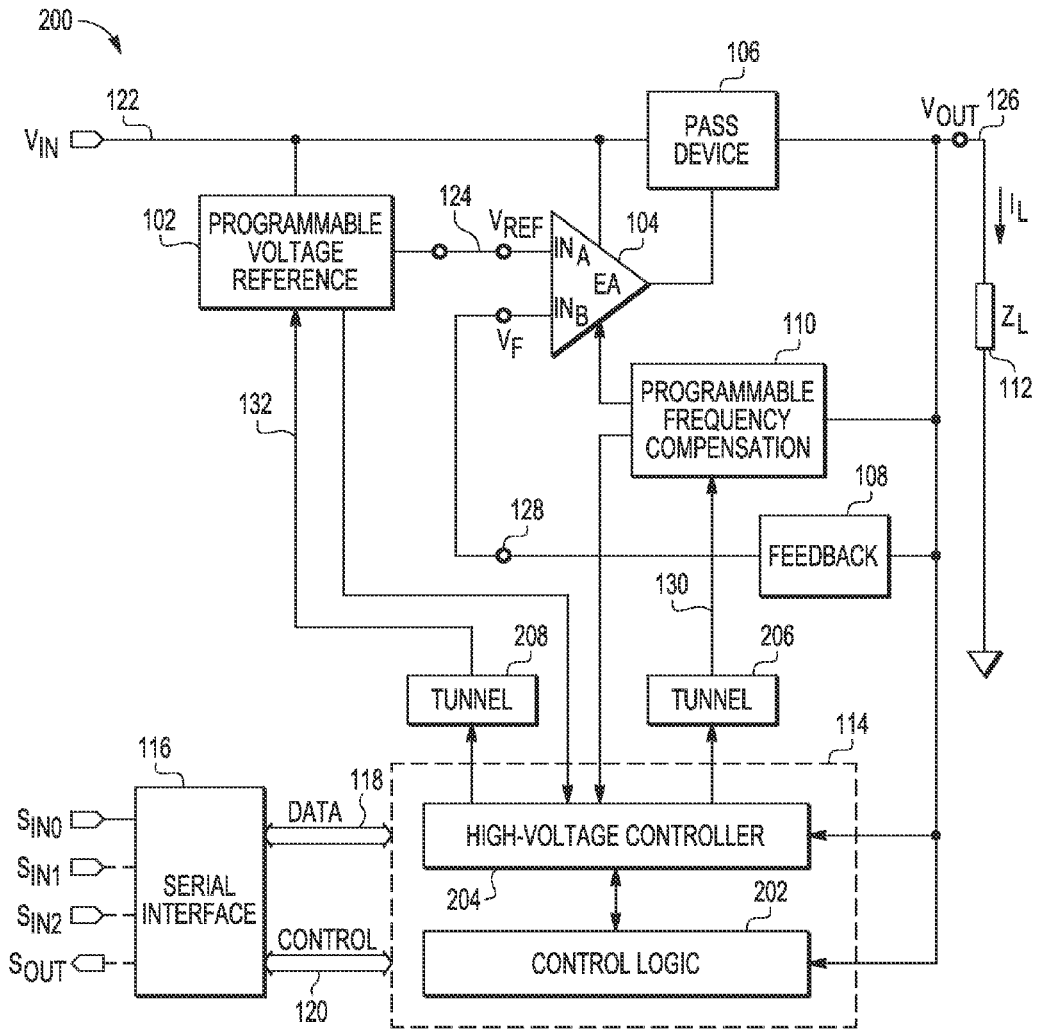
FIG. 2 is a partial schematic and partial block diagram of an embodiment of the programmable LDO regulator of FIG. 1.

FIG. 2 is a partial schematic and partial block diagram of an embodiment of an LDO regulator 200, such as the programmable LDO regulator of FIG. 1, including a high-voltage controller 204 and tunneling structures 206 and 208 for programming programmable voltage reference 102 and programmable frequency compensation circuit 110. In the illustrated embodiment, control circuit 114 includes control logic 202 and high-voltage controller 204, which are communicatively connected.

Control logic 202 is configurable to control the high-voltage controller 204. Additionally, control logic 202 may coordinate communication of data signals 118 and control signals 120 to and from an external source through serial interface 116. High-voltage controller 204 is connected to programmable voltage reference 102 through tunneling structure 208 and is connected to programmable frequency compensation circuit 110 through tunneling structure 206.

During a configuration process, high voltage controller 204 selectively applies a high voltage signal through tunneling structure 206 to one or more floating gates of a respective one or more floating-gate MOS devices of a reference source associated with programmable frequency compensation circuit 110 to adjust at least one frequency compensation parameter. The high-voltage signals may be generated using a charge pump (not shown). Alternatively, programming signals may be received from an external source via serial interface 116.

Additionally, during a configuration process, high voltage controller 204 selectively activates one or more switches, such as those depicted in FIG. 3 below, to isolate the programmable voltage reference 102 from error amplifier 104 and applies a high voltage signal through tunneling structure 208 to one or more floating gates of a respective one or more floating-gate MOS devices of programmable voltage reference 102. An embodiment of a voltage-mode programmable reference circuit including programmable floating-gate MOS devices is depicted below in FIG. 3.

Figure 3:
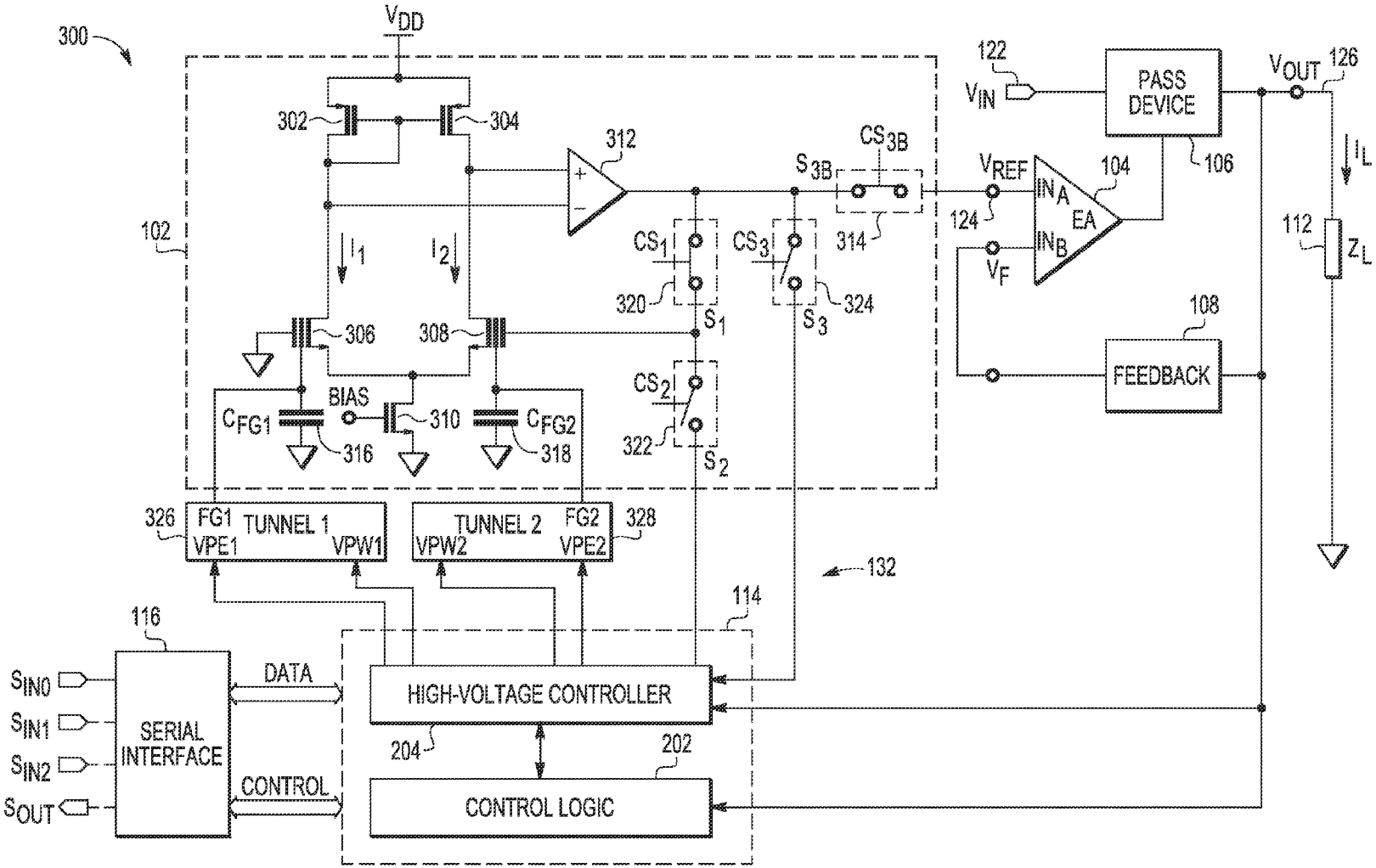
FIG. 3 is a partial schematic and partial block diagram of an embodiment of the voltage-mode reference circuit of the LDO regulators of FIGS. 1-2, including programmable floating-gate transistors.

FIG. 3 is a partial schematic and partial block diagram of an embodiment of a programmable LDO regulator 300 including an embodiment of the programmable voltage reference 102 implemented as a voltage-mode reference circuit including programmable floating-gate transistors 306 and 308. Alternatively, the programmable voltage reference can be implemented as a current-mode reference including programmable floating-gate transistors. In the illustrated embodiment, programmable voltage reference 102 includes PMOS transistors 302 and 304, which have common sources connected to a power supply terminal ($V_{DD}$) and common control-gates. PMOS transistor 302 includes a drain connected to the common gates and to a positive input of an amplifier 312. PMOS transistor 304 includes a drain connected to a negative input of amplifier 312.

Floating-gate transistor 306 includes a drain connected to the drain of PMOS transistor 302, a control-gate connected to ground, and a source. Floating-gate transistor 308 includes a drain connected to the drain of PMOS transistor 304, a control-gate connected to an amplifier output of amplifier 312 through a switch 320 and to high-voltage controller 204 through a switch 322. Second floating-gate transistor 308 also includes a source connected to the source of the first floating gate-transistor 306. The sources of floating-gate transistors 306 and 308 are connected to a drain of NMOS transistor 310, which includes a gate for receiving a bias signal and a source connected to ground.

Floating gate transistor 306 has a programmable floating gate, which is configured to store a charge, represented by capacitor 316. The programmable floating gate is connected to tunneling structure 326, which is connected to high-voltage controller 204 for programming the charge. Floating gate transistor 308 has a programmable floating gate, which is configured to store a charge, represented by capacitor 318. The programmable floating gate is connected to tunneling structure 328, which is connected to high-voltage controller 204 for programming the charge.

Programmable voltage reference 102 further includes switches 314 and 320 to selectively connect the amplifier output of amplifier 312 to a first input of error amplifier 104 to provide the reference voltage ($V_{REF}$) and to the gate of transistor 308. Additionally, programmable voltage reference includes switches 322 and 324 to selectively connect the gate of transistor 308 and the output of amplifier 312 to the high voltage controller 204. High-voltage controller 204 and/or control logic 202 selectively configures switches 320, 322, 314, and 324 for programming or for operation.

In an operating mode, switches 320 and 314 are closed and switches 322 and 324 are open. A first current ($I_1$) flows through floating-gate transistor 306 and a voltage signal on the drain of the floating-gate transistor 306 (which is programmed according to the floating-gate electric charge represented by capacitor 316) is presented to a negative input of amplifier 312. A second current ($I_2$) flows through floating-gate transistor 308 and a voltage signal on the drain of the floating-gate transistor 308 (which is programmed according to the floating-gate charge represented by capacitor 318) is presented to a positive input of amplifier 312. Amplifier 312 produces an output signal related to the voltage signals at its positive and negative inputs. The output signal is provided as a reference voltage ($V_{REF}$) at the first input of error amplifier 104 and is applied to the gate of floating-gate transistor 308 to provide negative feedback.

During a programming mode, switches 320 and 314 are open and switches 322 and 324 are closed. In this mode, the gate of floating-gate transistor 308 is connected to the high voltage controller 204, which controls the voltage on the gate and which applies a high-voltage charge to the programmable floating gates of floating-gate transistors 306 and 308 through tunneling devices 326 and 328. The output of amplifier 312 acts as a comparator that provides an output signal used by high voltage controller 204 to control the programming of the programmable reference circuit 102.

In an example, high-voltage controller 204 is configured to apply a high voltage signal to the tunneling device 326, to adjust the electric charge on the floating gate of transistor 306. At the same time, high voltage controller 204 applies a target reference voltage level to the gate of the floating gate transistor 308, thus providing a specific floating-gate to source voltage difference which determines a DC bias point for transistor 308. The programming of floating-gate transistor 306 is aimed toward adjusting the electric charge on the floating-gate in such a way to generate a floating-gate to source voltage difference for transistor 306 similar to that of transistor 308. When both transistors 306 and 308 of the differential pair achieve equivalent bias conditions, the amplifier 312, which acts as a comparator, generates a signal that is provided to high voltage controller 204 through switch 324 in order to conclude the programming cycle.

In another example, the high voltage controller 204 further applies a high-voltage cycle to the tunneling structure 328 in order to program the floating-gate transistor 308. High voltage controller 204 and control logic 202 cooperate to adjust the floating-gate charges of floating gate transistors 306 and 308 to adjust their equivalent threshold voltages in order to produce a desired reference voltage, which is provided to error amplifier 104 to control the output voltage.

In the illustrated embodiment, the programmable frequency compensation circuit 110 is omitted. However, it should be understood that, in other embodiments, the programmable frequency compensation circuit 110 can be included.

Figure 4:
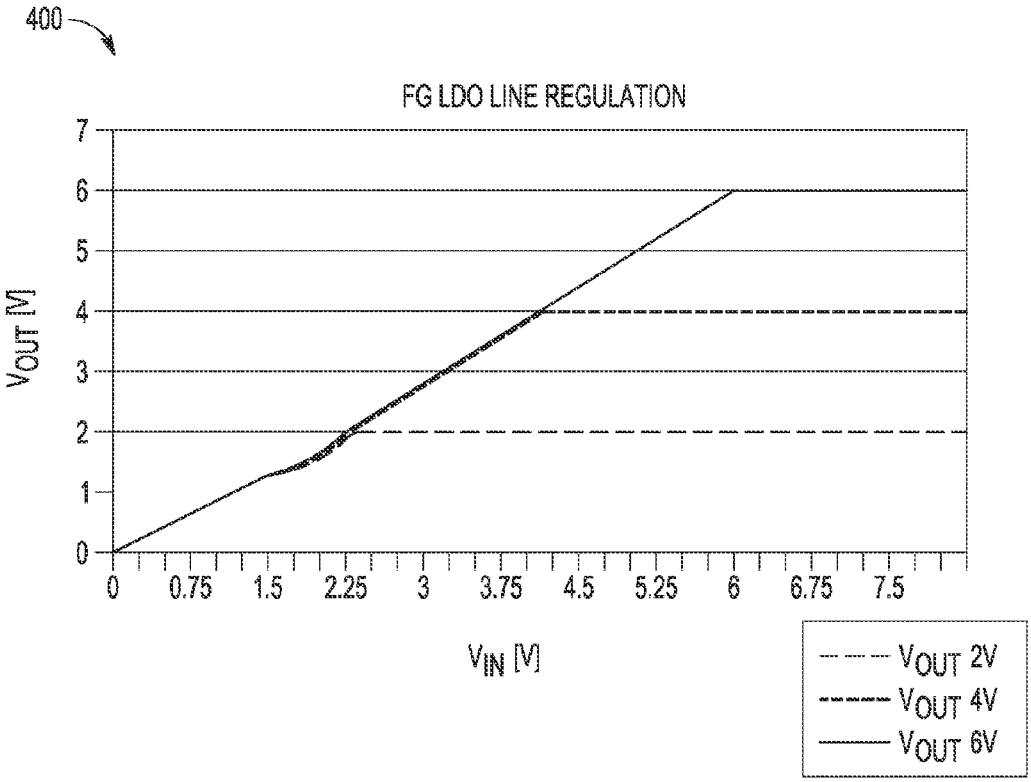
FIG. 4 is a diagram of output voltage versus input voltage for the LDO regulator of FIGS. 1-3.

FIG. 4 is a diagram 400 of output voltage versus input voltage for an embodiment of an LDO regulator, such as the LDO regulator of FIGS. 1-3, configured to support a load current of 1000 mA and implemented using a 0.25 μm technology. The diagram 400 illustrates that the floating-gate reference line regulation produces a substantially stable output voltage even for relatively low input voltages. For example, when the LDO regulator is programmed to produce a nominal output voltage of 2V, the output has a relatively linear variation for input voltages in a range from about 0.25 volts to about 2.25 volts and, for voltages above 2.25 volts, the LDO regulator produces a stable 2.0 volt output voltage. Similarly for target output voltages of 4 volts and 6 volts, the LDO regulator produces a substantially linear output voltage for input voltages in a range from about 0.25 volts to about 0.25 volts above the target voltage, and then produces a stable output voltage at the desired output voltage. Thus, a stable output voltage is provided even at relatively low input-output differential voltages.

Further, the LDO regulator of FIGS. 1-3 is stable, which stability can be demonstrated by examining the pole and zero placement on a root-locus diagram in the frequency domain. Examples of the frequency compensation provided by the LDO regulators of FIGS. 1-3 are provided in the diagrams 500 and 600 in FIGS. 5 and 6 below, with and without frequency compensation programming (or trimming), respectively.

Figure 5:
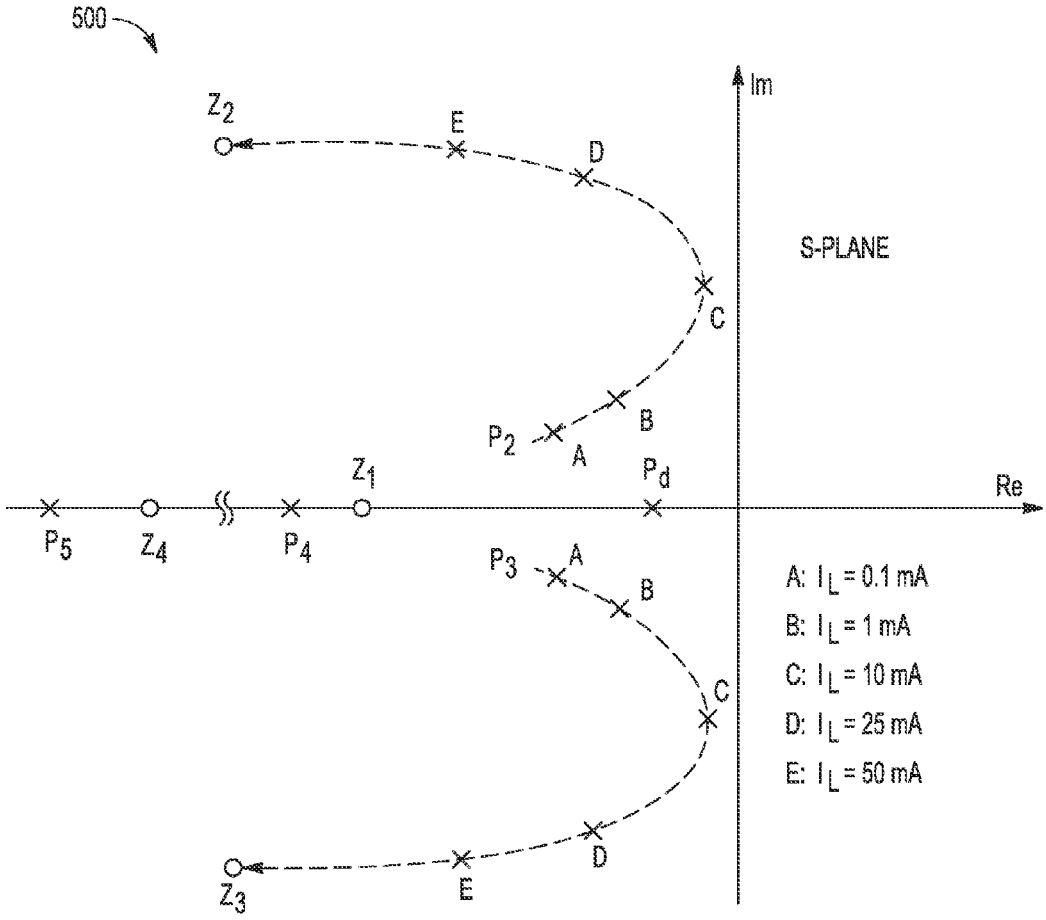
FIG. 5 is a root-locus diagram of pole and zero locations of a frequency response of the embodiment of the LDO regulators of FIG. 1-3 at various load currents before frequency compensation trimming.

FIG. 5 is a root-locus diagram 500 of poles and zeros locations of a frequency response of the embodiment of the LDO regulators of FIGS. 1-3 at various load currents before trimming. The LDO regulator circuit is stable before trimming, meaning that all poles and zeros are in quadrants 2 and 3 of the root-locus diagram 500; however, at a load current ($I_L$) of approximately 10 mA, the locus of the poles $P_2$ and $P_3$ approaches the Y-axis. Though stability is not compromised, the frequency response of the LDO regulator becomes less capable of the desired performance, with larger overshoots and undershoots, and with a reduced phase margin. Thus, it would be desirable to adjust the pole and zero locations to enhance stability.

Figure 6:
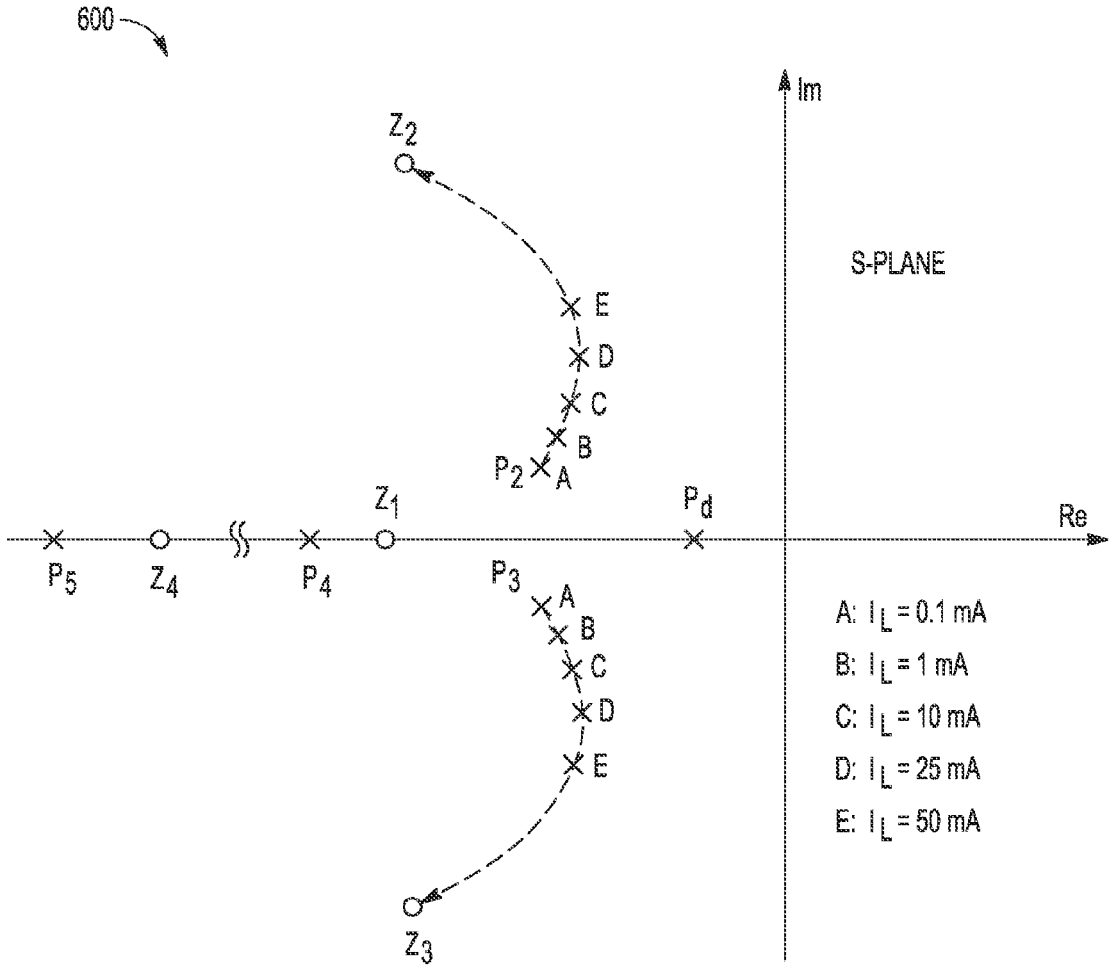
FIG. 6 is a root-locus diagram of pole and zero locations of a frequency response of the embodiment of the LDO regulators of FIGS. 1-3 at various load currents after frequency compensation trimming.

FIG. 6 is a root-locus diagram 600 of poles and zeros locations of a frequency response of the embodiment of the LDO regulator of FIGS. 1-3 at various load currents after trimming (i.e., after programming). In an example, the frequency response is configurable using the programmable frequency compensation circuit depicted in FIGS. 1-2 and 7. Diagram 600 illustrates that second and third poles are shifted left, increasing stability of the LDO regulator. Further, the adjustment of frequency response can be used to increase the speed of the transient response and to reduce overshoots, undershoots, and ringing of the output voltage signal with respect to the desired output voltage.

As compared to diagram 500 in FIG. 5, root-locus diagram 600 shows that the second and third poles are shifted left, further away from the Y-axis and well within the left-hand plane of the imaginary domain, for the same load currents as the non-trimmed LDO regulator. Thus, after trimming, the LDO regulator has an improved transient response and a better phase margin, and is rendered more stable as compared to the non-trimmed LDO regulator.

Figure 7:
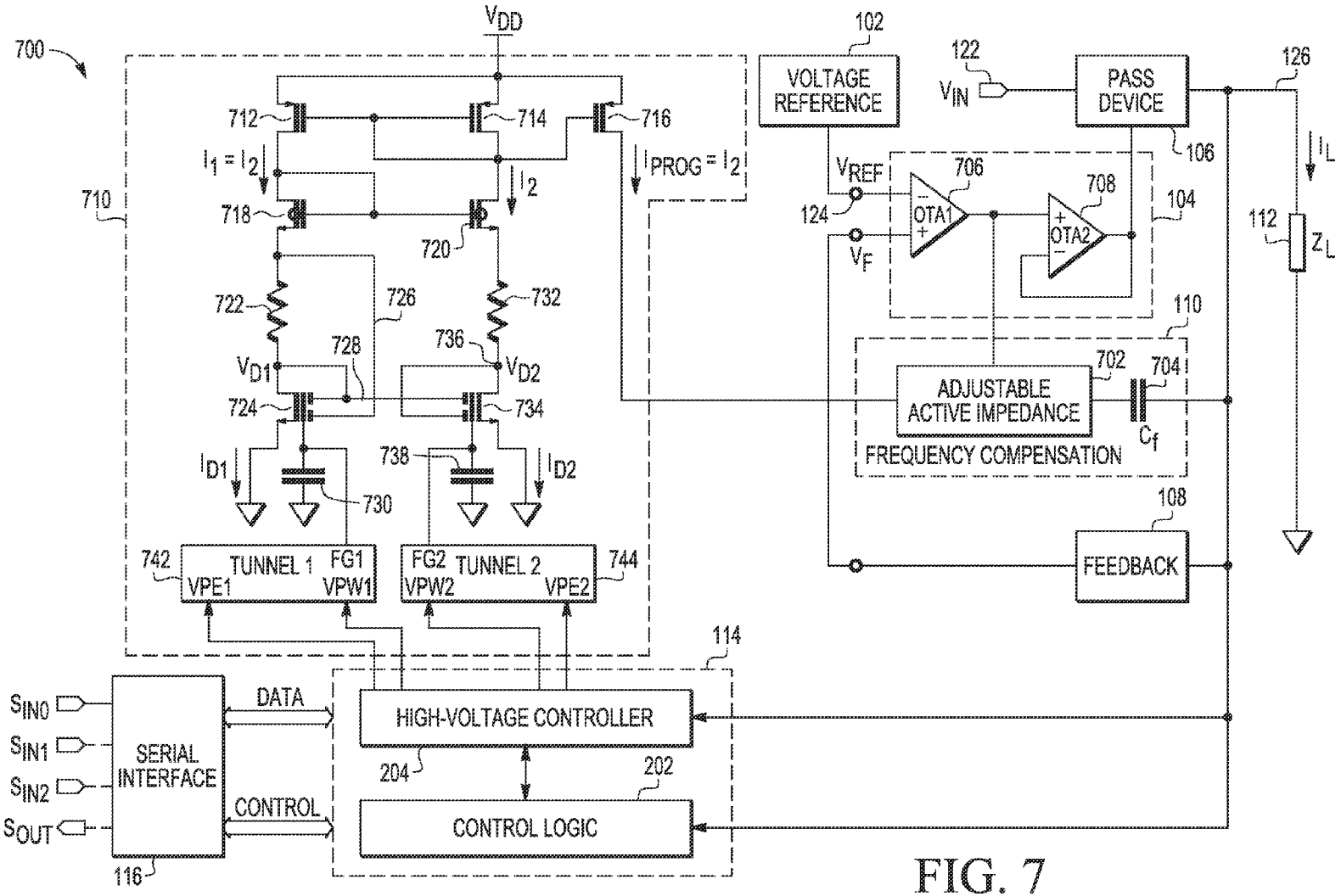
FIG. 7 is a partial schematic and partial block diagram of another embodiment of a programmable LDO regulator including a current-mode reference circuit.

FIG. 7 is a partial schematic and partial block diagram of an embodiment of a programmable LDO regulator 700, such as the LDO regulator 100 of FIG. 1, including an embodiment of a current-mode reference circuit 710 configurable to control a programmable frequency compensation circuit 110. Programmable frequency compensation circuit 110 includes a capacitor 704 connected to output terminal 126 and to an adjustable active impedance 702, which is connected to current-mode reference circuit 710 to receive a programmable current ($I_{PROG}$). Further, programmable frequency compensation circuit 110 is connected to error amplifier 104. In an embodiment, adjustable active impedance 702 may include an adjustable gain stage.

Error amplifier 104 includes a first amplifier 706 including a negative input connected to programmable voltage reference 102, a positive input connected to feedback terminal 128, and a first amplifier output connected to adjustable active impedance 702. Error amplifier 104 further includes a second amplifier 708 including a positive input connected to the first amplifier output, a negative input connected to pass device 106, and a second amplifier output connected to its negative input and to the pass device 106.

Adjustable active impedance 702 is responsive to the programmable current ($I_{PROG}$) from current-mode reference circuit 710. Current-mode reference circuit 710 includes PMOS transistors 712, 714, and 716 having common sources connected to a power supply terminal ($V_{DD}$) and common gates. PMOS transistor 712 includes a drain connected to a drain of intrinsic transistor 718, which includes a gate that is diode-connected to its drain and which includes a source. PMOS transistor 714 includes a drain connected to the common gates of PMOS transistors 712, 714, and 716. Further, the drain of PMOS transistor 714 is connected to a drain of an intrinsic (or zero threshold voltage) transistor 720, which includes a gate connected to the gate of intrinsic transistor 718 and which includes a source. PMOS transistor 716 includes a drain connected to adjustable active impedance 702 to provide the programmable current ($I_{PROG}$), which controls a frequency compensation parameter, such as an impedance or a gain, associated with adjustable active impedance 702.

Current-mode reference circuit 710 includes a resistor 722 having a first terminal connected to the source of intrinsic transistor 718 and a second terminal connected to a drain and to a first control-gate 728 of a dual floating-gate MOS device 724. MOS device 724 further includes a second control-gate connected to the first terminal of resistor 722, as indicated by line 726. MOS device 724 also includes a programmable floating gate, which has a programmable charge represented by capacitor 730. Tunneling structure 742 couples the programmable floating gate of MOS device 724 to high voltage controller 204 to allow control circuit 114 to configure the programmable charge on the floating gate.

Current-mode reference circuit 710 also includes a resistor 732 having a first terminal connected to the source of intrinsic transistor 720 and a second terminal connected to a drain of a dual floating-gate MOS device 734. MOS device 734 includes a first control-gate connected to the first control-gate 728 of MOS device 724, a second control-gate connected to the second terminal of resistor 732, and a source connected to ground. MOS device 734 also includes a programmable floating gate, which has a programmable charge represented by capacitor 738. Tunneling structure 744 couples the programmable floating gate of MOS device 734 to high voltage controller 204 to allow control circuit 114 to configure the programmable charge on the floating gate.

Transistors 712 and 714 are connected in a current mirror configuration. Intrinsic transistor 718 is diode-connected, and intrinsic transistor 720 has its gate in common with the gate of intrinsic transistor 718, biasing the first terminal of resistor 722 and the first terminal of transistor 732, respectively, at approximately equal voltage level. A first current ($I_1$) flows across resistor 722 creating a voltage differential from a voltage on its first terminal to a drain voltage ($V_{D1}$) on its second terminal. Similarly, a second current ($I_2$) flows across resistor 732 creating a voltage differential from a voltage on its first terminal to a drain voltage ($V_{D2}$) on its second terminal. The first control-gate of MOS transistor 724 is diode connected, and a common drain voltage ($V_{D1}$) is applied both to the gate 728 of a first gate of MOS transistor 724 and to the first control-gate of MOS transistor 734. A second voltage associated with the first terminal of resistor 722 is applied to the second control-gate of MOS transistor 724. The second control gate of MOS transistor 734 is diode-connected and is biased by the drain voltage ($V_{D2}$).

The voltage difference between the second gate electrodes of MOS transistors 724 and the first gate electrode of MOS transistor 724 operates to control current flow, establishing a current I1 which is reflected through MOS transistor 734. The differential voltage operates to adjust the current flow through MOS transistor 724 to control the second current ($I_2$) and the frequency compensation programming current ($I_{PROG}$). Assuming that PMOS transistors 712, 714, and 716 have substantially equal sizes and that intrinsic transistors 718 and 720 have substantially equal sizes, the first current ($I_1$) is substantially equal to the second current ($I_2$), which is substantially equal to the programmable current ($I_{PROG}$), which biases the frequency compensation circuit 110 to adjust a frequency compensation parameter.

Thus, current-mode reference circuit 710 provides an analog adjustment for frequency compensation. The floating gate charges configure the operating points of MOS transistors 724 and 734, and the interconnections of the gate electrodes bias the MOS transistors 724 and 734 to provide a continuous current adjustment of the frequency compensation circuit 710. While current-mode reference circuit 710 is depicted as separate from programmable frequency compensation circuit 110, it should be understood that the current-mode reference circuit 710 may be included within programmable frequency compensation circuit 110.

Additionally, in an alternative embodiment, the current-mode reference circuit 710 may be replaced with a voltage-mode reference, such as the embodiment of the voltage mode reference circuit 102 depicted in FIG. 3, which reference voltage may be converted to a programmable current and applied to the frequency compensation circuit 110.

In conjunction with the LDO regulators and programming methods disclosed above with respect to FIGS. 1-7, an LDO regulator includes a programmable voltage reference and a programmable frequency compensation circuit, which include programmable floating-gate MOS devices that can be configured to control DC and AC parameters of an output voltage.

Although the present invention has been described with reference to preferred embodiments, workers skilled in the art will recognize that changes may be made in form and detail without departing from the scope of the invention.

What is claimed is:

1. A low-dropout (LDO) regulator comprising:

a programmable voltage reference including at least one floating-gate transistor coupled to a reference output and configurable to provide a reference voltage;

a pass device including an input terminal coupled to a voltage input, an output terminal to provide a voltage output, and a pass control input;

a feedback circuit including a feedback input terminal coupled to the output terminal and a feedback output terminal;

an error amplifier including a first error amplifier input coupled to the reference output for receiving the reference voltage, a second error amplifier input coupled to the feedback output terminal, and an error amplifier output coupled to the pass control input of the pass device; and a control circuit having a data input and configurable to program an electric charge on the at least one floating-gate transistor determined by the data input to adjust the reference voltage and to control the output voltage.

2. The LDO regulator of claim 1, wherein the programmable voltage reference comprises:

a first floating-gate transistor including a drain for receiving a first current, a control gate coupled to ground, and a source;

a second floating-gate transistor including a drain for receiving a second current, a control gate and a source coupled to the source of the first floating-gate transistor; and a reference amplifier including a first reference amplifier input coupled to the drain of the first floating-gate transistor, a second reference amplifier input coupled to the drain of the second floating-gate transistor, and a reference amplifier output coupled to the control gate of the second floating gate transistor and comprising the reference output for providing the reference voltage.

3. The LDO regulator of claim 2, wherein the control circuit is configurable to selectively program the first and second floating-gate transistors to control the reference voltage.

4. The LDO regulator of claim 2, wherein the control circuit comprises:

a high voltage controller configurable to perform a programming operation on at least one of the first and second floating-gate transistors; and a control logic circuit coupled to the high voltage controller and configurable to control the programming operation to program the output voltage.

5. The LDO regulator of claim 1, further comprising:

a programmable frequency compensation circuit comprising:

a first compensation terminal coupled to the output terminal of the pass device;

a second compensation terminal coupled to the error amplifier;

a capacitor including a first terminal coupled to the first compensation terminal and including a second terminal; and an adjustable active impedance including a first impedance terminal coupled to the second terminal of the capacitor and a second impedance terminal coupled to the second compensation terminal.

6. The LDO regulator of claim 5, further comprising:

a serial interface coupled to the control circuit and configurable to couple to an external source to receive data and control signals; and wherein the control circuit is responsive to the control signals to selectively program at least one of the programmable voltage reference and the programmable frequency compensation circuit.

7. The LDO regulator of claim 5, wherein the programmable frequency compensation circuit comprises:

a current-mode reference circuit including at least one floating-gate transistor configurable to produce a frequency compensation reference current; and wherein the adjustable active impedance is responsive to the frequency compensation reference current to produce a desired frequency compensation for the output voltage.

8. The LDO regulator of claim 7, wherein the control circuit is configurable to program a floating-gate of the at least one floating-gate transistor to control the frequency compensation reference current.

9. The LDO regulator of claim 5, wherein the error amplifier comprises:

a first amplifier including a first amplifier input for receiving the reference voltage, a second amplifier input coupled to the output terminal of the feedback circuit, and a first amplifier output terminal coupled to the second compensation terminal of the programmable frequency compensation circuit; and a second amplifier including a first amplifier input coupled to the first amplifier output terminal, a second amplifier input, and a second amplifier output coupled to the pass device and to the second amplifier input of the second amplifier.

10. A low-dropout (LDO) regulator comprising;

a pass device including an input terminal coupled to a voltage input, an output terminal to provide an output voltage, and a pass control input;

a feedback circuit including a feedback input terminal coupled to the output terminal and a feedback output terminal;

an error amplifier including a first error amplifier input for receiving a reference voltage, a second error amplifier input coupled to the output terminal of the feedback circuit, and an error amplifier output coupled to the pass control input of the pass device;

a programmable reference circuit including at least one floating-gate transistor, the programmable reference circuit configurable to produce a reference signal;

a programmable frequency compensation circuit including a first compensation input coupled to the output terminal, a second compensation input for receiving the reference signal, and a compensation output coupled to the error amplifier, the programmable frequency compensation circuit responsive to the reference signal to adjust the frequency response of the output voltage; and a control circuit configurable to program an electric charge on the at least one floating-gate transistor to adjust the reference signal to control at least one frequency response component of the output voltage.

11. The LDO regulator of claim 10, wherein the programmable frequency compensation circuit comprises:

a first compensation terminal coupled to the output terminal of the pass device;

a second compensation terminal coupled to the error amplifier, a capacitor including a first capacitive terminal coupled to the first compensation terminal and including a second capacitive terminal; and an adjustable active impedance including a first impedance terminal coupled to the second capacitive terminal, a second impedance terminal coupled to the second compensation terminal, and a compensation control input coupled to the programmable reference circuit.

12. The LDO regulator of claim 10, wherein the programmable reference circuit comprises:

a current mirror circuit comprising an output current electrode for providing the reference signal;

an adjustable active impedance comprising a first impedance terminal coupled to the current mirror circuit and including a second impedance terminal;

a first dual floating-gate transistor comprising:

a drain coupled to the second impedance terminal;

a first control gate coupled to the drain;

a second control gate coupled to the first impedance terminal; and a source coupled to a power supply terminal;

a second dual floating-gate transistor comprising:

a drain coupled to the current mirror circuit;

a first control gate coupled to the first gate of the first dual floating-gate transistor;

a second control gate coupled to the drain of the second dual floating-gate transistor; and a source coupled to the power supply terminal.

13. The LDO regulator of claim 12, wherein the control circuit is configurable to selectively program the first and second dual floating-gate transistors to control the reference signal.

14. The LDO regulator of claim 10, further comprising:

a programmable voltage reference including a reference output coupled to the first error amplifier input, the programmable voltage reference including at least one floating-gate transistor configurable to adjust the reference voltage.

15. The LDO regulator of claim 14, wherein the programmable voltage reference comprises:

a first floating-gate transistor including a drain for receiving a first current, a control gate coupled to ground, and a source;

a second floating-gate transistor including a drain for receiving a second current, a control gate, and a source coupled to the source of the first floating-gate transistor; and a reference amplifier including a first reference amplifier input coupled to the drain of the first floating-gate transistor, a second reference amplifier input coupled to the drain of the second floating-gate transistor, and a reference amplifier output coupled to the control gate of the second floating gate transistor for providing the reference voltage.

16. The LDO regulator of claim 15, wherein the control circuit is configurable to selectively program the first and second floating-gate transistors to control the reference voltage.

17. A method of providing an output voltage using a programmable dropout (LDO) regulator, the method comprising:

receiving a voltage input signal at an input of the programmable LDO regulator;

receiving configuration data through a serial interface of the programmable LDO regulator;

generating a reference voltage using a programmable reference circuit programmed according to the configuration data, said generating comprising programming an electric charge of at least one floating-gate transistor according to the configuration data to adjust the reference voltage;

regulating the voltage input signal using a series pass device coupled to the input and configured to produce the output voltage at an output terminal;

sampling the output voltage using a feedback circuit configured to produce a feedback voltage;

comparing the feedback voltage to the reference voltage using an error amplifier configured to produce an error signal at an amplifier output of the error amplifier, the amplifier output coupled to the series pass device to adjust the output voltage; and providing frequency compensation according to the configuration data using a programmable frequency compensation circuit coupled to the error amplifier.

18. The method of claim 17, further comprising:

providing the reference voltage to the error amplifier to produce the error signal to control the series pass device; and providing the output voltage of the series pass device to the output terminal of the programmable LDO regulator.

19. The method of claim 17, further comprising:

programming an electric charge of at least one floating-gate transistor of a current reference circuit of the programmable LDO regulator according to the configuration data to adjust a frequency compensation parameter of the programmable frequency compensation circuit.

* * * * *

UNITED STATES PATENT AND TRADEMARK OFFICE

CERTIFICATE OF CORRECTION

PATENT NO. : 8,400,126 B2
APPLICATION NO. : 12/760150
DATED : March 19, 2013
INVENTOR(S) : Radu H. Iacob et al.

It is certified that error appears in the above-identified patent and that said Letters Patent is hereby corrected as shown below:

In the Claims

In column 9, line 42, claim 10, replace “comprising;” with “comprising:”.

In column 10, line 66, claim 17, replace “dropout” with “low-dropout”.

Signed and Sealed this
Twenty-third Day of July, 2013

Teresa Stanek Rea
*Acting Director of the United States Patent and Trademark Office*